US007458674B2

(12) United States Patent
Itoh

(10) Patent No.: US 7,458,674 B2
(45) Date of Patent: Dec. 2, 2008

(54) INK DRYING TIME CREATING DUPLEX PRINTING APPARATUS

(75) Inventor: Yutaka Itoh, Ebina (JP)

(73) Assignee: Ricoh Company Limited, Tokyo (JP)

( * ) Notice: Subject to any disclaimer, the term of this patent is extended or adjusted under 35 U.S.C. 154(b) by 303 days.

(21) Appl. No.: 11/332,174

(22) Filed: Jan. 17, 2006

(65) Prior Publication Data

US 2006/0158501 A1 Jul. 20, 2006

(30) Foreign Application Priority Data

Jan. 17, 2005 (JP) ..... 2005-009240
Sep. 29, 2005 (JP) ..... 2005-283838

(51) Int. Cl.
*B41J 2/01* (2006.01)
*B41J 29/38* (2006.01)
*B41J 29/393* (2006.01)

(52) U.S. Cl. ..... 347/104; 347/16; 347/19

(58) Field of Classification Search ..... 347/7, 347/16, 19, 14, 104
See application file for complete search history.

(56) References Cited

U.S. PATENT DOCUMENTS 4,918,490 A * 4/1990 Stemmle ..... 399/401
5,095,342 A * 3/1992 Farrell et al. ..... 399/401
5,159,395 A * 10/1992 Farrell et al. ..... 399/401
5,184,185 A * 2/1993 Rasmussen et al. ..... 399/130
5,337,135 A * 8/1994 Malachowski et al. ..... 399/401
6,069,704 A * 5/2000 Verhaag ..... 358/1.12
7,025,452 B2 * 4/2006 Sakai et al. ..... 347/104
7,185,981 B2 * 3/2007 Tham et al. ..... 347/104
2003/0103248 A1 * 6/2003 Sciurba et al. ..... 358/498

FOREIGN PATENT DOCUMENTS

JP 2004-181696 7/2004

* cited by examiner

*Primary Examiner*—Stephen D Meier
*Assistant Examiner*—Leonard S Liang
(74) *Attorney, Agent, or Firm*—Oblon, Spivak, McClelland, Maier & Neustadt, P.C.

(57) ABSTRACT

A duplex printing apparatus includes a conveying device that conveys the printing sheet at a prescribed average line speed, a comparison device that compares skip suppression information with a prescribed threshold, and a speed changing device that decreases the prescribed average line speed in accordance with a comparison result of the comparison device.

5 Claims, 6 Drawing Sheets

INK DRYING TIME CREATING DUPLEX PRINTING APPARATUS

CROSS REFERENCE TO RELATED APPLICATIONS

This application claims priority under 35 USC §119 to Japanese Patent Application Nos. 2005-009240 and 2005-283838, filed on January 17 and September 29, both 2005, the entire contents of which are hereby incorporated by reference.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

1. Field of the Invention

The present invention relates to a printing apparatus capable of executing duplex printing, and in particular to a printing apparatus creating a drying time for drying ink on a front side of a printing sheet.

2. Discussion of the Background art

In an ink jet printing apparatus capable of executing duplex printing on both sides of a printing sheet, it is known that a user manually inverts a printing sheet after printing an image on a front side surface. Specifically, when a duplex printing mode is designated, a plurality of printing sheets are launched from a sheet feed tray and images of odd number pages are firstly printed onto front side surfaces of the plurality of printing sheets.

Then, the printing sheets with odd number page images are set to the sheet feed tray by the user, and are launched and receive even number page printings on their rear sides. When images are to be printed on more than three pages of the printing sheets, printing of even number page images starts when all of the odd number page images have been printed.

According to such an ink jet printing apparatus, the printing sheet is stained by a friction of a feed roller that pressure contacts the surface of the printing sheet. Also, stein of a sheet feed pad and that caused during a transfer process spread to the printing sheet. In view of these, Japanese Patent Application Laid Open Nos. 2003-226060, and 2203-320727 attempt to suppress these steins.

Specifically, printing data of first and second risky regions of a front side surface to be printed are compared with each other. Then, printing data of a rear side surface is outputted without being inverted when an amount of printing data of the first risky region is smaller than that of the second risky region.

Whereas printing data is inverted and outputted when an amount of printing data of the second risky region is smaller than that of the first risky region. Further, the rear side surface is fed in the same direction as the front side surface when the amount of printing data of the first risky region is smaller than that of the second risky region. The rear side surface is fed in the opposed direction to that of the front side surface when the amount of printing data of the second risky region is smaller than that of the first risky region. As a result, the above-mentioned steins are suppressed.

SUMMARY OF THE INVENTION

Accordingly, an object of the present invention is to improve such background arts and provides a new and novel duplex printing apparatus including a printing head that prints an image on a printing sheet, a conveying device that skips a blank portion of the printing sheet at a prescribed speed, and a comparison device that compares skip suppression information with a prescribed threshold. A speed changing device is provided to decrease the prescribed speed in accordance with a comparison result of the comparison device.

In another embodiment, the prescribed skip suppression information represents a distance of the blank portion.

In yet another embodiment, a total ink amount calculation device is provided to calculate a total amount of ink to be used in a printing page. The prescribed skip suppression information represents the total ink amount.

In yet another embodiment, an ink amount accumulating device is provided to accumulate an amount of ink used in printing in a main scanning direction.

In yet another embodiment, a determination device is provided to determine if printing is executed to a front or rear side surface of the printing sheet. The speed changing device decreases the prescribed speed in accordance with a determination result of the determination device.

In yet another embodiment, the prescribed threshold is assigned to front and rear side surfaces of the printing sheet. The prescribed threshold for the rear side surface is lower than that of the front side surface.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
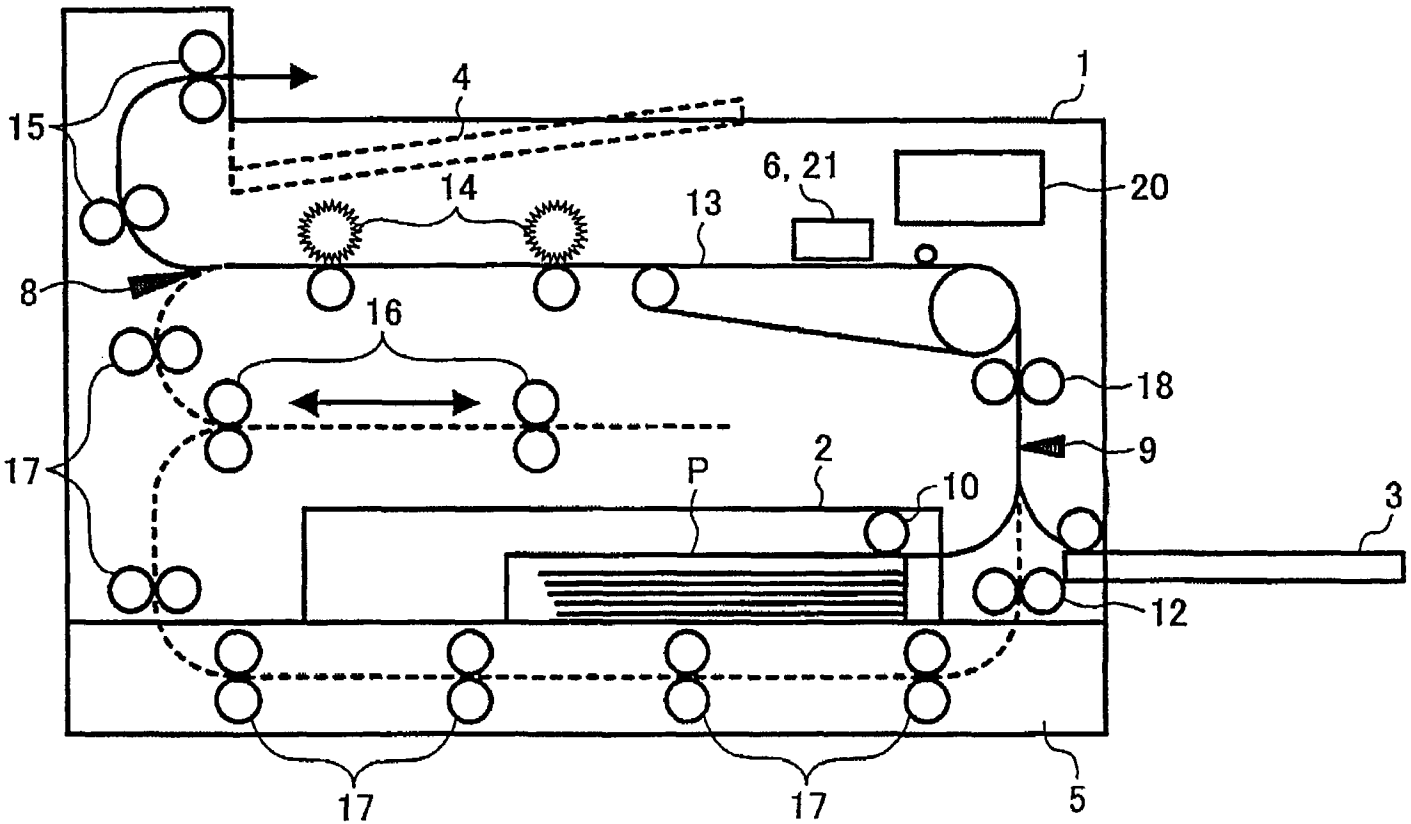
FIG. 1 illustrates an exemplary ink jet printer according to one embodiment of the present invention.

Referring now to the drawing, wherein like reference numerals designate identical or corresponding parts throughout several views. An ink jet printer sometimes includes a printing sheet inversion mechanism or path for executing duplex printing.

A plain paper of a printing sheet generally needs a prescribed time period to dry ink carried thereon. In particular, when the second surface is printed before the first surface sufficiently dries, and the printing sheet passes through the inversion path, an image is damaged by a friction of a conveyance roller or blurs on the second surface.

On the other hand, when a printing head is moved in a main scanning direction and an image does not exist continuously in a sub scanning direction, a printing sheet is preferably moved to a position of the next image without printing as a skipping operation.

According to one embodiment of the present invention, such a skipping operation is restricted in a prescribed manner as mentioned later in detail. For example, the maximum of a skipping length is restricted in a prescribed level and a length skipping length is divided more than twice to skip. Thus, an average line speed of a printing sheet is decreased. Thereby, an ink drying time is sufficiently created.

Now, an exemplary ink jet printer of one embodiment of the present invention is described with reference to FIG. 1. The ink jet printer 1 includes a sheet feeding section 2 that accommodates a plurality of sheets, a manual sheet feeding section 3, a sheet ejection section 4, and a duplex section 5, or the like. When a printing request comes from a personal computer externally connected over a network, a sheet feeding roller 10 separates and upwardly feeds the sheets P one by one. The sheet P is then temporarily stopped at a position of a registration sensor 9 to align a leading edge of the sheet with a registration roller 18. Then, the registration roller 18 starts feeding the sheet P at a prescribed time in synchronism with an output of image data.

Upon reaching, the sheet P is conveyed by the conveyance belt 13. A plurality of heads 6 for cyan, yellow, magenta, and black colors are arranged and execute printings above a flat surface of the conveyance belt 13. A horizontal conveyance roller and a spur 14 cooperatively convey the sheet P after the printing. When a time needed for drying ink has elapsed, a switching pick changes a path for the sheet P either to the sheet ejection section 4 or the duplex section 5. When a simplex printing is to be executed, the sheet P is fed to an sheet ejection roller 15, and is then inverted and ejected onto the sheet ejection section 4 while inclining the switching pick to a solid line side. When a duplex printing is to be executed, the sheet P is fed to an inversion roller 16 and is inverted while inclining the switching pick 8 to a dotted line side. The sheet P then advances to the registration roller 18 again through a path extending over a duplex sheet feeding roller 17 and a vertical conveyance roller 12 included in the duplex section 5. After that, a rear side surface receives an image in the same manner as the front side surface. After image formation to the rear side surface is completed, the separation pick 8 is inclined again to the solid line side, and the sheet is fed toward the sheet ejection roller 15 and is ejected onto the sheet ejection section 4.

Figure 2:
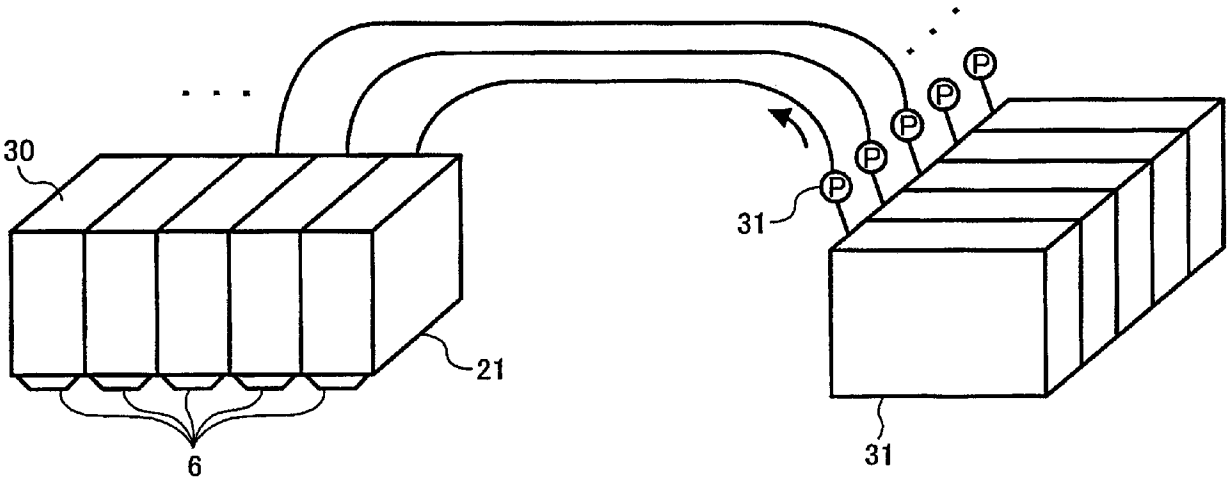
FIG. 2 illustrates an exemplary ink cartridge, a head, and a substitute tank include in the ink jet printer shown in FIG. 1.

Now, an exemplary large capacity ink cartridge, a head, and a substitute tank included in an ink jet printer are described with reference to FIG. 2. As shown, the large capacity ink cartridge 20 is enabled to be replaced by a user per color when it is emptied. An ink remaining amount detection sensor (not shown) is arranged in the large capacity ink cartridge 20 to output a signal so that existence of the ink therein can be detected based on the signal.

When it is determined that the large capacity ink cartridge 20 is emptied, such an effect is displayed on a display section (not shown) so as to urge a user to replace the old large capacity ink cartridge 20 to a new. Since the substitute tank 21 is emptied after execution of a prescribed amount of printing with a prescribed density for a prescribed amount of data, a carriage 30 advances to a filling work position. That is, a sensor (not shown) is arranged to confirm an amount of ink remaining in the substitute tank 21. Further, a suction mechanism (not shown) is arranged so as to avoid clogging of the head 6. Those devices are arranged so that the head 6 can be cleaned, ink can be discharged as a trial to prevent a head 6 not used for a long time from clogging, and a prescribed mechanism (not shown) can wipe the head 6 when the ink is filled at the filling work position.

Figure 3:
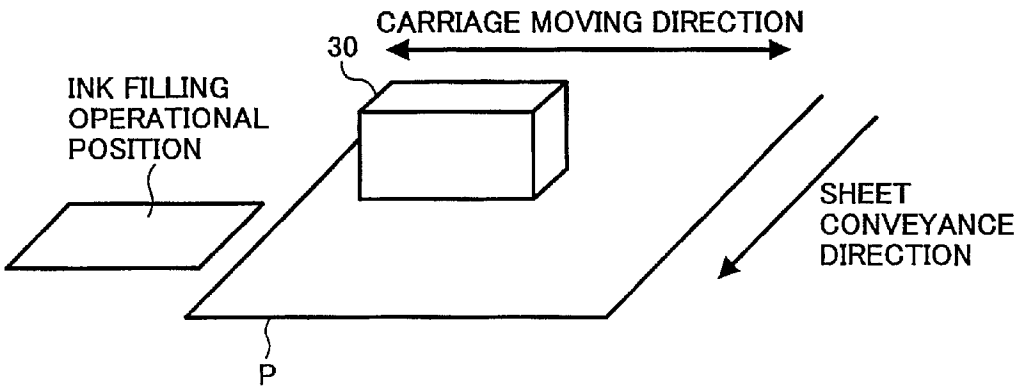
FIG. 3 illustrates an exemplary operation of the head according to one embodiment of the present invention.

An exemplary printing of a head 6 onto a sheet P is now described with reference to FIG. 3. A sheet P is conveyed while a carriage integrally mounting the head 6 and the substitute tank 21 executes scanning in a direction perpendicular to a conveyance direction of the sheet P so as to form an image. Then, the head 6 discharges ink onto the sheet P in accordance with printing data per color.

Figure 4:
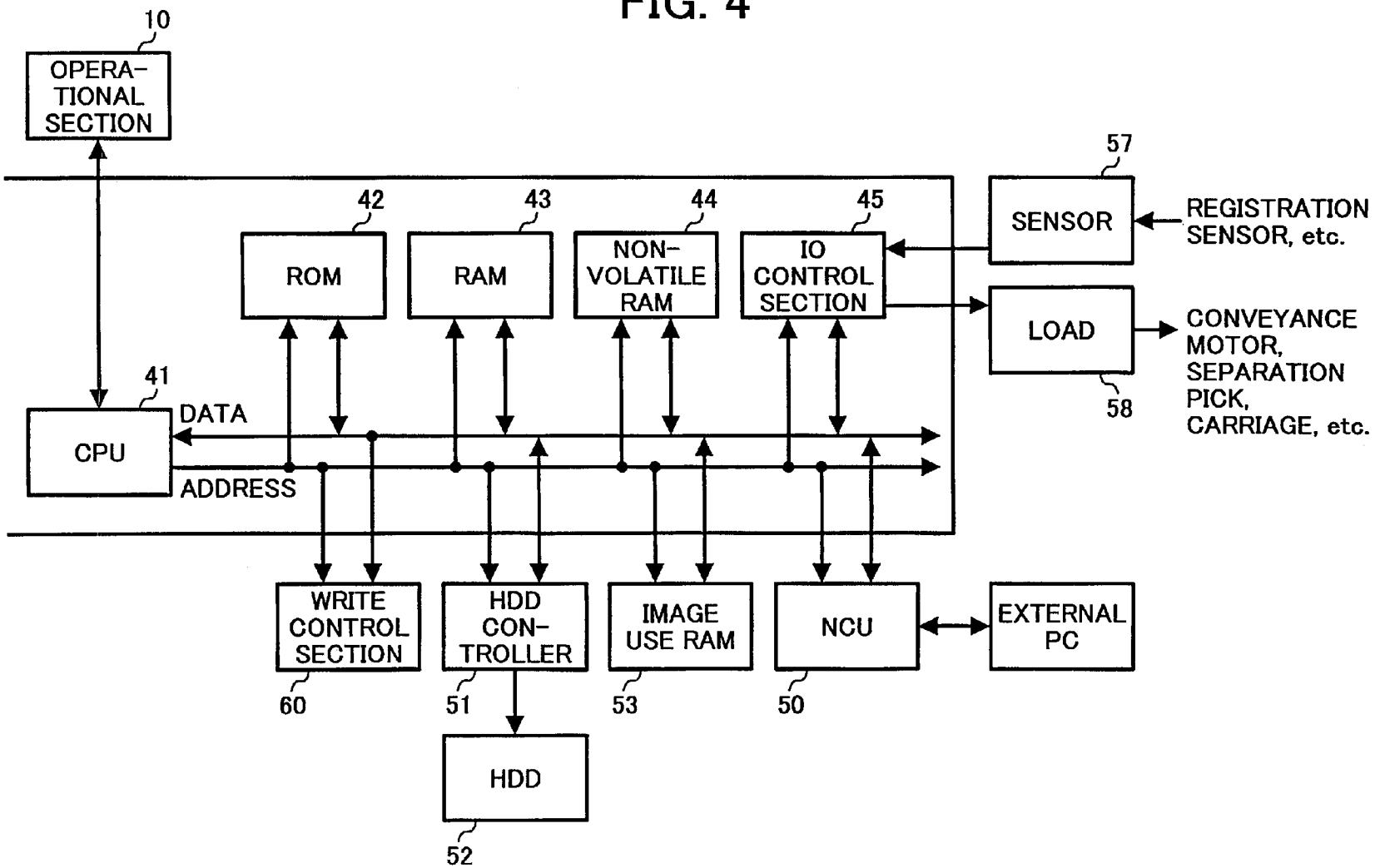
FIG. 4 illustrates a block chart showing the ink jet printer as shown in FIG. 1.

An exemplary control section of the ink jet printer 1 is now described with reference to FIG. 4. The control section includes a CPU 41, a ROM 42 that stores program that operates the CPU 41, and a program use work ROM 43. Also included are a non-volatile RAM 44 that stores data, such as an adjustment value of a control time, etc., even when power supply is turned off, a conveyance motor (not shown) that drives a plurality of conveyance rollers based on an input from a sensor 57, such as a registration sensor 9 of the ink jet printer 1, etc., and an IO controller 45 that controls various loads 58 such as a pick, 8, a carriage 30, an ink replenishment pump 31, etc.

Further, the control section includes a network control unit (NCU) 50 that is connected to a personal computer and receives data of printing and controlling.

Image data is externally received from a personal computer via the NCU 50, and is temporarily stored in an image data use RAM 53. Then, the image data is converted to printing data by the CPU 41, and is stored in the HDD 52 controlled by a HDD controller 51. Then, the image data stored in the HDD 52 is read by the HDD 52 and is inputted into a write control section 60 at a prescribed time in synchronism with a conveyance of the sheet P. The print control section 60 converts and executes discharging of ink from the head 6 in accordance with the image data input, thereby printing an image on the sheet P.

An exemplary operation of an ink jet printer 1 according to one embodiment of the present invention is described with reference to FIGS. 5 to 11. First, an exemplary sequence of determining one of simplex and duplex printings is now described. It is initially determined if it is a duplex printing in step S100. For example, when a user designates a printing mode through an operation control section 10, the CPU 10 determines the mode based on the designation. If it is negative (i.e., No, in step S100), a skip suppression flag is turned off in step S102. The CPU 41 may turn off the skip suppression flag referred to by the write control section 60. In contrast, if it is positive (i.e., Yes, in step S100), the CPU 41 turns on the skip suppression flag in step S101.

Figure 5:
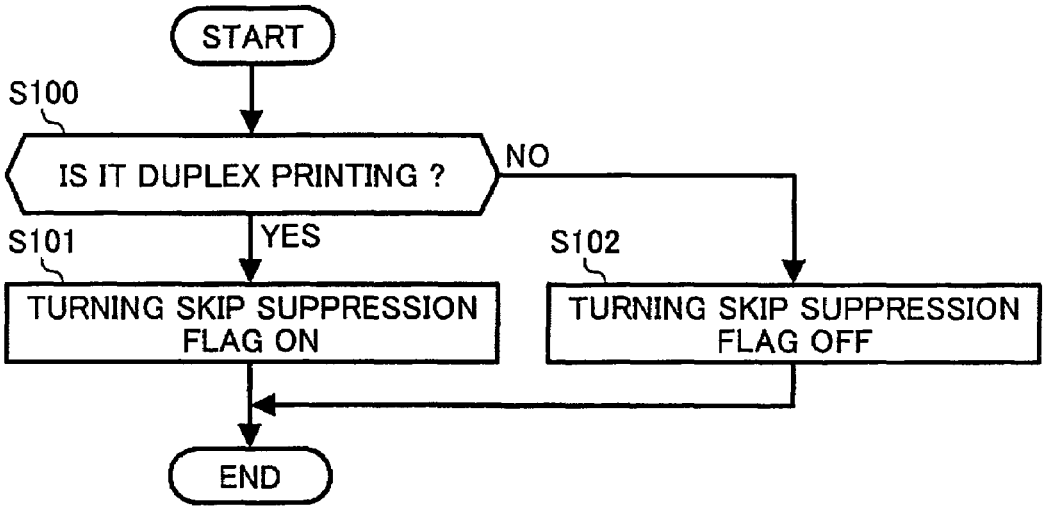
FIG. 5 illustrates an exemplary sequence of determining if printing is executed to either one side or both sides.
Figure 6:
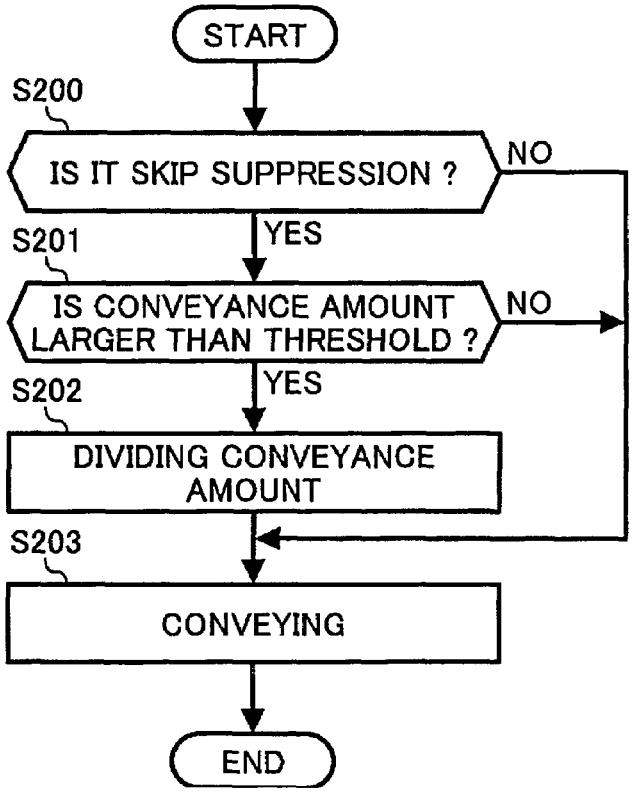
FIG. 6 illustrates an exemplary sequence of determining if a conveyance amount is to be divided according to one embodiment of the present invention.

An exemplary sequence of determining if a conveyance length (i.e., a skipping length) is to be divided is now described with reference to FIG. 6. Initially, it is determined if the skipping suppression is executed in step S200. Such a determination may be executed as shown in FIG. 5.

Specifically, if the skip suppression flag is turned off (i.e., No, in step S200), a sheet is fed as it is in step S203. Further, if the skip suppression flag is turned on (i.e., Yes, in step S200), it is further determined if a conveyance amount is more than a prescribed threshold in step S201. The conveyance amount may be compared with a prescribed threshold to determine if the former exceeds the latter. If it is negative (i.e., No, in step S201), the sheet is fed as it is in step S203. In contrast, if it is positive (i.e., Yes, in step S201), the conveyance length is shortened and the sheet P is intermittently fed in steps S202 and S203.

Figure 7:
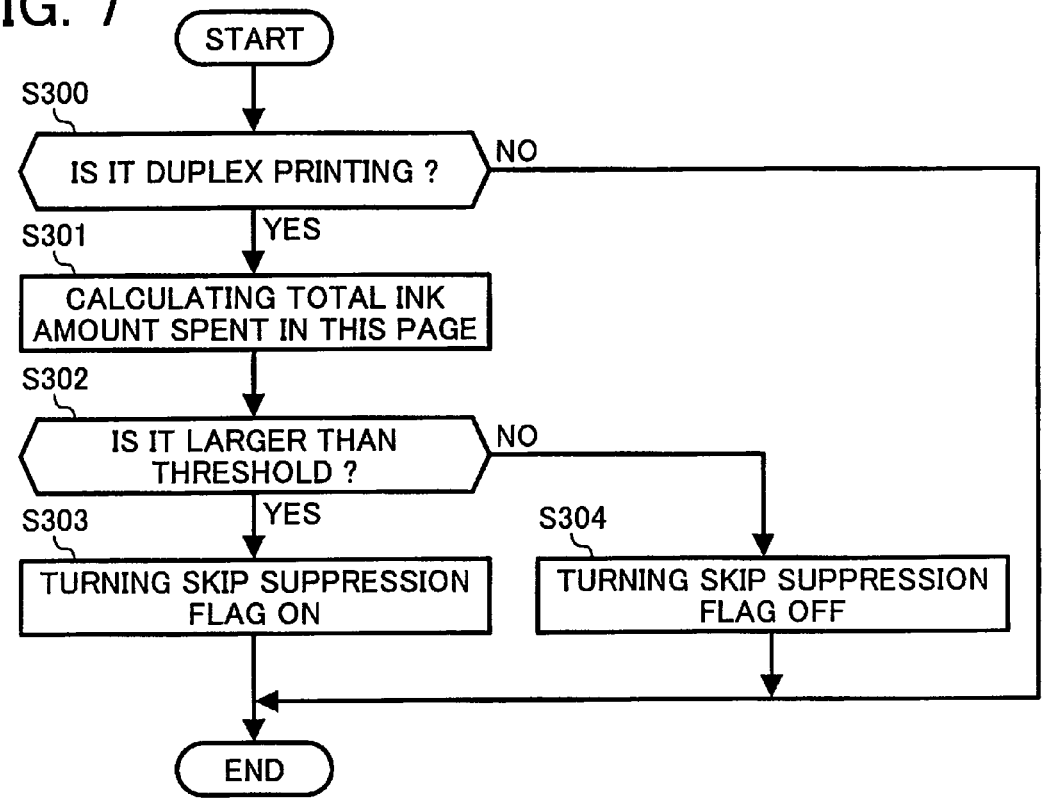
FIG. 7 illustrates an exemplary sequence of calculating a total ink amount according to one embodiment of the present invention.

Now, another exemplary skipping suppression operation executed based on an amount of ink to be spent is described with reference to FIG. 7. First, it is determined if the duplex printing is executed in step S300. For example, when a user designates a printing mode through an operation control section 10, the CPU 41 determines the mode based on the designation. If the decision is negative (i.e., No, in step S300), the process is terminated.

If the decision is positive (i.e., Yes, in step S300), the total amount of ink to be used in printing on a page is calculated in step S301. Such calculation is executed based on image data read by the write control section 60 from the HDD 52.

Then, the calculated total ink amount is compared with a previously set threshold of an ink usage amount in step S302. If the former does not exceed the latter, accordingly the comparison result is negative (i.e., No, in step S302), a skip suppression flag is turned off in step S304. If the comparison result is positive (i.e., Yes, in step S304), the flag is turned on in step S303.

Figure 8:
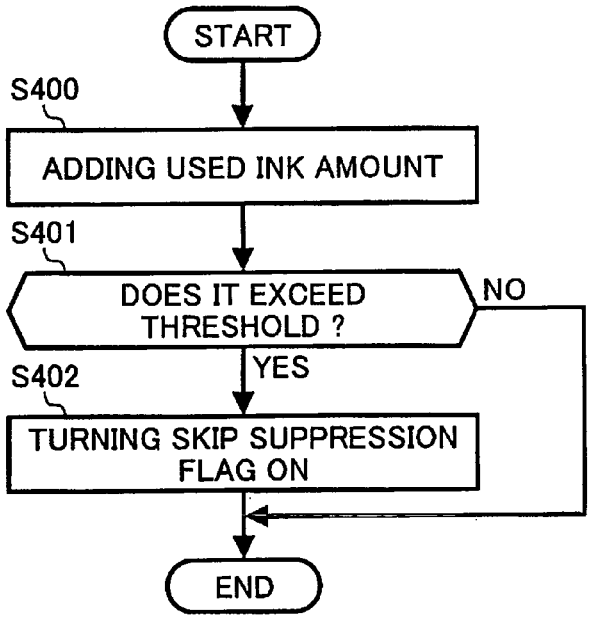
FIG. 8 illustrates an exemplary sequence of determining if suppression of a skipping operation is to be executed according to one embodiment of the present invention.

Now, an exemplary sequence of starting the skip suppression is described with reference to FIG. 8. First, a usage ink amount is accumulated in step S400. For example, a usage ink amount is calculated based on a printing activity of the write control section 60, and is accumulated every time when printing is executed in a main scanning direction. Then, the accumulated ink amount practically used is compared with the above-mentioned previously set threshold in step S401.

If the accumulated ink amount does not exceed the threshold, accordingly, comparison result is negative (i.e., No, in step S401), the process is terminated as is. If the comparison result is positive (i.e., Yes, in step S401), the skip flag is turned on (in step S402).

Figure 9:
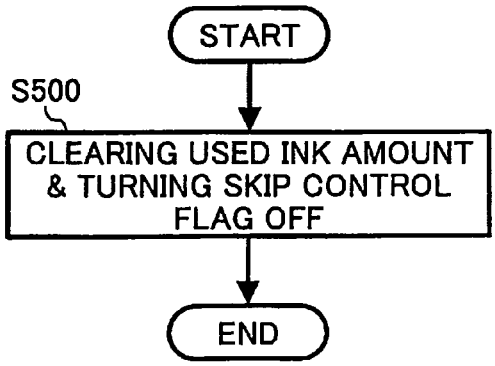
FIG. 9 illustrates an exemplary sequence executed when a page printing is completed according to one embodiment of the present invention.

When the write control section 60 completes the printing activity, information of the usage ink amount is cleared, and the skip suppression flag is turned off as shown in step S500 of FIG. 9.

Figure 10:
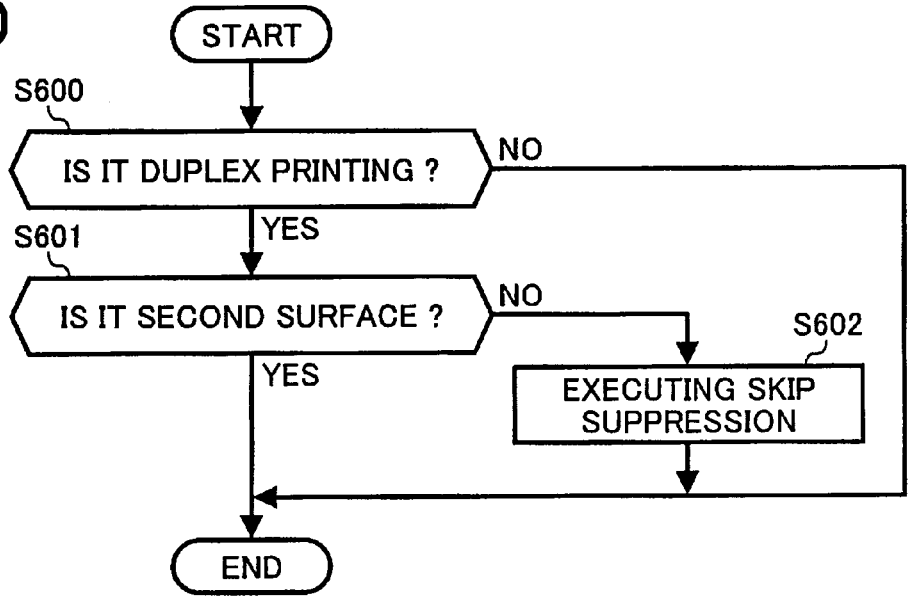
FIG. 10 illustrates an exemplary sequence of determining if a present printing is executed for the second page or not according to one embodiment of the present invention.

Now, an exemplary sequence of determining if a current printing page is either a first or second surface is described with reference to FIG. 10, wherein the first page is a surface to firstly execute a printing, the second surface, a rear side surface to secondly execute a printing during duplex printing, respectively.

Initially, it is determined if the duplex printing is executed (in step S600). For example, when a user designate a printing mode through am operation control section 10, the CPU 41 determines the mode based on the designation. If the determination is negative (i.e., No, in step S600), the process is terminated as it is. If the determination is positive (i.e., Yes, in step S600), it is further determined if the current printing page is the second surface in step S601.

A determination as a simplex printing can be made by detecting if a simplex printing is designated or a sheet P is conveyed from the sheet feeding section 2 to a registration sensor 9. A determination as a duplex printing can be made by detecting if a sheet P is conveyed from the duplex section 5. Further, a determination as a simplex printing can be made by detecting id a sheet P is fed from the sheet feeding section 2 while the sheet ejection section 4 is its ejection destination.

If the current printing page is the second surface (i.e., Yes, in step S601), the process is terminated as it is. If the current printing page is not the second surface (i.e., No, in step S601), the skip suppression is executed (in step S602).

Figure 11:
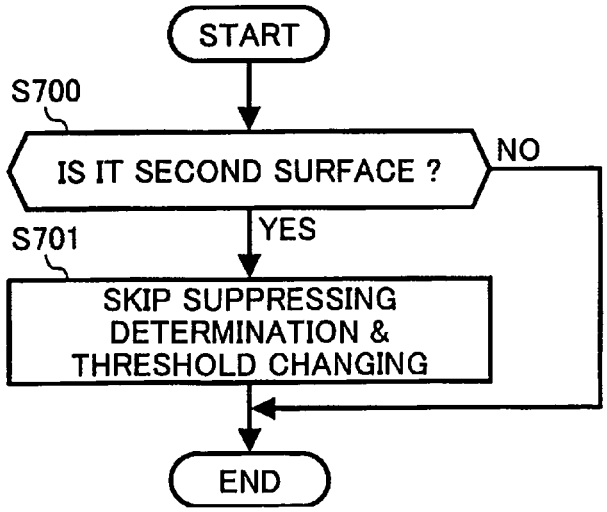
FIG. 11 illustrates an exemplary sequence of changing a threshold that determines if the skipping operation is to be suppressed according to one embodiment of the present invention.

Now, an exemplary sequence of changing a threshold for determining necessity of skipping suppression is described with reference to FIG. 11. First, it is determined if the current printing page is the second surface (in step S700). If the determination is negative (i.e., No, in step S700), the process is terminated as it is. If the determination is positive (i.e., Yes, in step S700), a determination threshold for the skip suppression is changed in step S701. Since a conveyance path for ejecting the sheet P after completion of printing is relatively long or the sheets P are promptly completely ejected being stacked, a longer ink drying time is preferably designated for the second surface than that for the simplex printing. Thus, the threshold used for skipping suppression in printing on the first surface is changed when the second surface is printed during the duplex printing as shown in FIGS. 7 to 9. Specifically, a condition of skipping suppression is moderate when a threshold to be compared with an ink total amount is decreased to be less than usual.

Numerous additional modifications and variations of the present invention are possible in light of the above teachings. It is therefore to be understood that within the scope of the appended claims, the present invention may be practiced otherwise that as specifically described herein.

What is claimed is:

1. A duplex printing apparatus, comprising:

a printing head configured to print an image on a printing sheet;

a conveying device configured to convey the printing sheet at a prescribed average line speed;

a comparison device configured to compare skip suppression information with a prescribed threshold;

a speed changing device configured to decrease the prescribed line speed in accordance with a comparison result of the comparison device; and a total ink amount calculation device configured to calculate a total amount of ink to be used in a printing page, wherein said prescribed skip suppression information represents the total ink amount.

2. The duplex printing apparatus as claimed in claim 1, wherein said prescribed skip suppression information represents a distance of the blank portion.

3. The duplex printing apparatus as claimed in claim 1, further comprising an ink amount accumulating device configured to accumulate an amount of ink used in printing in a main scanning direction.

4. The duplex printing apparatus as claimed in claim 1, further comprising an determination device configured to determine if printing is executed to a front or rear side surface of the printing sheet, wherein said speed changing device decreases the prescribed average line speed in accordance with a determination result of the determination device.

5. The duplex printing apparatus as claimed in claim 4, wherein said prescribed threshold is assigned to front and rear side surfaces of the printing sheet, wherein the prescribed threshold for the rear side surface is lower than that of the front side surface.

* * * * *